US006691544B2

(12) United States Patent
Steudle et al.

(10) Patent No.: US 6,691,544 B2
(45) Date of Patent: Feb. 17, 2004

(54) METHOD AND APPARATUS TO UNCOIL AND DEKINK COILED MATERIAL

(75) Inventors: Ernst W. Steudle, Clinton Township, MI (US); Robert Lamey, Livonia, MI (US)

(73) Assignee: U.S. Properties, Inc., Fraser, MI (US)

( * ) Notice: Subject to any disclaimer, the term of this patent is extended or adjusted under 35 U.S.C. 154(b) by 0 days.

(21) Appl. No.: 09/927,609

(22) Filed: Aug. 10, 2001

(65) Prior Publication Data

US 2003/0029214 A1 Feb. 13, 2003

(51) Int. Cl.[7] ..... B21D 1/02; B65H 16/02; B65H 20/00

(52) U.S. Cl. ..... 72/164; 72/183; 242/559.4; 242/563; 242/564.4

(58) Field of Search ..... 72/183, 160, 162, 72/164; 242/559.4, 563, 564.4

(56) References Cited

U.S. PATENT DOCUMENTS

| | | | | |
|---|---|---|---|---|
| 2,066,377 A | | 1/1937 | Wean et al. | |
| 2,070,444 A | * | 2/1937 | Mikaelson | 242/562.1 |
| 2,267,175 A | | 12/1941 | Skriba | |
| 2,318,320 A | | 5/1943 | McFadden | |
| 2,321,878 A | * | 6/1943 | Tyrrell | 72/164 |
| 2,508,977 A | * | 5/1950 | Todd | 72/163 |
| 2,571,947 A | | 10/1951 | Russell | |
| 2,622,816 A | * | 12/1952 | Koch | 242/559.4 |
| 2,679,363 A | | 5/1954 | Muddiman | |
| 2,734,405 A | | 2/1956 | Cozzo | |
| 2,746,511 A | | 5/1956 | Branthoover | |
| 2,756,943 A | | 7/1956 | Sieger | |
| 2,757,880 A | | 8/1956 | De La Motte | |
| 2,800,288 A | | 7/1957 | Bandy | |
| 2,887,147 A | | 5/1959 | Ficht | |
| 3,079,976 A | * | 3/1963 | Ranney | 72/164 |
| 3,188,846 A | | 6/1965 | Fugassi | |
| 3,326,026 A | * | 6/1967 | Guillot | 72/163 |
| 3,343,393 A | | 9/1967 | Groll | |
| 3,394,897 A | * | 7/1968 | Martin | 242/563 |
| 3,422,653 A | | 1/1969 | Wiig | |
| 3,442,108 A | * | 5/1969 | Muller | 72/164 |
| 3,461,703 A | * | 8/1969 | Ranney | 72/183 |
| 3,549,102 A | | 12/1970 | Sedlacek | |
| 3,635,417 A | | 1/1972 | Kajiwara et al. | |
| 3,685,760 A | | 8/1972 | Fedor | |
| 4,047,416 A | | 9/1977 | Johnson | |
| 4,070,891 A | | 1/1978 | Stretten | |
| 4,291,845 A | | 9/1981 | Van Cleave | |
| 4,344,605 A | | 8/1982 | Ganseuer et al. | |
| 4,355,526 A | | 10/1982 | Miles | |
| 4,399,729 A | | 8/1983 | Malinowski et al. | |
| 4,487,045 A | | 12/1984 | Lehmann et al. | |
| 4,549,700 A | | 10/1985 | Ganseuer | |
| 4,580,738 A | | 4/1986 | Scheer | |
| 4,608,844 A | | 9/1986 | Lehmann et al. | |

(List continued on next page.)

*Primary Examiner*—Daniel C. Crane
(74) *Attorney, Agent, or Firm*—VanOphem & VanOphem, P.C.

(57) ABSTRACT

An apparatus and method for handling web material paid off from a coil to a downstream end-use machine. The method generally includes automatically adjusting the height of the coil of web material to maintain a consistent payoff line, and includes dekinking the trailing end of the web material to prevent damage to downstream machines. The apparatus generally includes a reel-type uncoiler having a vertically adjustable mandrel and having a payoff roll biased into engagement with the outside diameter of the coil to define a payoff line of the web material. A dekinker is positioned just downstream of the uncoiler to dekink the trailing end of the web material and to thread the leading end of the web material into a downstream feeder. The dekinker includes a threader roll and a breaker roll pivotably mounted about a common pivot axis, wherein a kinked portion of web material is straightened therebetween.

43 Claims, 9 Drawing Sheets

U.S. PATENT DOCUMENTS 4,620,184 A 10/1986 Nedstedt
4,823,582 A * 4/1989 Bourbon et al. ..... 72/164
4,887,774 A * 12/1989 Phillips et al. ..... 242/559.4
4,953,808 A 9/1990 Craycraft
5,004,173 A 4/1991 Kawai
5,249,754 A 10/1993 Liermann et al.
5,312,057 A 5/1994 Graham
5,333,809 A 8/1994 Berry, III et al.
5,344,089 A 9/1994 Crowley et al.
5,413,304 A 5/1995 Kato
5,456,098 A 10/1995 Hartwig et al.
5,651,511 A 7/1997 Crowley et al.
6,067,835 A 5/2000 Pollock

* cited by examiner

METHOD AND APPARATUS TO UNCOIL AND DEKINK COILED MATERIAL

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to material handling systems and methods. More specifically, this invention relates to apparatus and a related method for supporting, uncoiling, dekinking, and feeding coiled material.

2. Description of the Related Art

Material handling systems are used in various applications to unwind a coil of web material and convey the web material to a downstream machine. Such applications include but are not limited to wire feeding, paper feeding, sheet metal feeding, and the like. The typical coil is wound from a discrete length of material having a leading end that terminates an outside diameter of the coil and a trailing end that terminates an inside diameter of the coil.

Sheet metal uncoilers of the prior art are typically included as one piece of a material handling system amongst others including a threading mechanism, a straightener/feeder machine, and ultimately a metalworking machine such as a press. The typical uncoiler includes a cradle or reel that supports the coil of material.

A cradle usually includes a base frame structure having a pair of spaced apart and parallel support rollers mounted thereto. The rollers support the outside diameter of the coil of web material such that the coil rests freely thereon. A pair of opposed sidewalls are typically mounted to the base frame structure to restrain the sides of the coil and thus prevent "telescoping" of the coil. The sidewalls are usually laterally adjustable towards and away from one another to accommodate various widths of coils to be loaded to the cradle.

One type of reel uncoiler includes a base frame structure having a single support shaft or roller that is mounted to the base frame structure and that supports the coil through the inside diameter thereof. Another type of reel includes a base frame structure having opposed adjustable arms that terminate in chucks for supporting the inside diameter of a coil at the sides thereof. Both types of reels typically include a drive roll that engages the outside diameter of the coil for rotating the coil to wind or unwind the coil.

There are numerous problems with both types of uncoiler systems of the prior art. Cradle-type uncoilers suffer from three significant disadvantages. First, if the coil is not positioned correctly when it is initially loaded to a stationary cradle, it can be very difficult to recenter, especially if the coil is very heavy. Second, the side edges of the coil often get bound up or damaged between the side plates when the coil "telescopes". Specifically, the side plates shave slivers from the side edges of the coil and the slivers tend to accumulate in downstream stamping dies, resulting in damage thereto. Third, coils are supported only by line contact atop the cradle support rollers and the enormous weight and light gauge of some coils makes it difficult to run quality material. Sheet metal thickness for automotive body panels has decreased drastically over the last several decades, from approximately 0.039" to about 0.023". Heavy coils of this lighter gauge material can experience more than 1,000 psi on the outside diameter of the material. This extremely high pressure tends to plastically displace material out at the edges of the coil. This is because the coils are more rigidly supported at their sides and are more forgivingly supported at the center due to the natural sag of a support roll at the center. This phenomenon is known as "wavy edge" and tends to adversely affect downstream die operations. A cradle-type uncoiler is typified by U.S. Pat. No. 4,487,045 to Lehmann et al.

As a solution to the above-mentioned problems with cradle-type uncoilers, reel-type uncoilers have been developed, but have three significant limitations of their own. First, a typical reel uncoiler usually requires a separate straightener-feeder system, other additional equipment, and a take-up loop of the material to achieve proper payoff of the material, thereby adding substantial length to the line between the coil and the press. This limitation is typified by U.S. Pat. No. 4,953,808 to Craycraft and U.S. Pat. No. 5,651,511 to Crowley et al., wherein space consuming take-up loops are evident. Second, it is difficult to thread heavy gauge material with the coil supported at a fixed height. Use of different size coils having various outside diameters makes it impossible to use a typical fixed length threader device since the leading end of the material is at a significantly different location for each varying size of coil diameter. Third, existing reel uncoilers are sometimes inadequate to prevent a coil from "watchspringing" once a restraining band is released from the coil. For example, neither the Craycraft nor Crowley et al. references make even a passing mention about alleviating the watchspringing problem.

Moreover, neither the cradle-type nor reel-type uncoilers of the prior art have provided an adequate mechanism for dekinking the trailing edge of a coil of heavy gauge material. The trailing edge of a coil of heavy gauge material is often kinked into a "coil end bend" that is either produced from steel mill equipment when initially winding the coil or from a rewind mandrel clamp when loading the coil to the mandrel. U.S. Pat. No. 4,487,045 to Lehmann et al. teaches use of a threader bar roller in combination with a fixed removal roller to decurl a trailing end of a coil roll. This combination enables easier acceptance of the material by input rolls of a straightener and precludes a doubled over coil thickness of material from being rolled over, thereby avoiding substantial damage and downtime to the downstream straightener and press. Unfortunately, however, the Lehmann et al. combination is not effective for dekinking heavy gauge material since the rollers do not cooperate closely under forces sufficient to dekink such material.

Rather than dekinking a trailing edge of coiled sheet stock, many prior art devices cut the ends off of a length of stock at the beginning and end of each coil. U.S. Pat. No. 4,344,605 to Ganseuer et al. teaches use of just such a device. Ganseuer et al. disclose a fixed support structure having a horizontal support cradle thereon for holding a coil. The support structure includes a gap spaced downwardly from the cradle, through which material from the coil passes. A cutting torch or shear blades are translatably fixed to a portion of the support structure beneath the gap, such that the torch traverses across the path of the material to cut it off. Such a system wastes valuable coiled material, results in scrap and a messy work environment, and is a relatively high maintenance design.

U.S. Pat. No. 4,070,891 to Stretten teaches an apparatus for peeling the leading end of coiled sheet metal and for debending and straightening a trailing end of the sheet metal. FIG. 1 thereof illustrates the typical material handling system of the prior art requiring a space-consuming loop. A debender is positioned just downstream of a cradle-type uncoiler. The debender includes a lower forming die and a complementary upper forming die that are aligned with guideposts. Sheet metal from the coil flows between the upper and lower dies. A pair of pneumatic cylinders drive the upper die down toward the lower die along the guideposts. In operation, a bent trailing edge of the sheet metal is momentarily stopped between the two dies, and the pneumatic cylinders are actuated to reshape the trailing edge. This arrangement requires a completely separate and relatively complex mechanism that serves no other purpose but to dekink the edges of the material.

From the above, it can be appreciated that uncoiling systems of the prior art are not fully optimized to provide a consistent height of a material payoff line, to accommodate heavy coils of thin gauge material, or to dekink heavy gauge material. Therefore, what is needed is a novel apparatus incorporating a vertically traversing reel-type uncoiler and a dekinker cooperating with the uncoiler, and a related method.

BRIEF SUMMARY OF THE INVENTION

According to the present invention, there is provided an apparatus and method for uncoiling a coil of web material and dekinking the leading and trailing edges of the web material. The apparatus includes a unique uncoiler, a unique dekinker, and a conventional feeder. The apparatus conveys material paid off from a coil of the material to a machine downstream of the apparatus. The feeder is positioned downstream, includes pinch rolls for pulling the material through the feeder, and also includes straightener rolls for working and straightening the material therebetween. The dekinker is positioned just upstream of the feeder and includes a threader roll and a breaker roll positioned below the threader roll. The threader and breaker rolls are independently displaceable with respect to one another to compress and straighten out a kinked length of the material therebetween. The uncoiler is positioned just upstream of the dekinker and includes a mandrel extending through an inside diameter of the coil. A displacement apparatus is mounted to the mandrel for vertically displacing the mandrel to control the height at which the material is paid off from the coil.

In another aspect of the present invention, there is provided a method of conveying material from a coil to a machine downstream. The method includes uncoiling the coil of material by supporting the coil from an inside diameter thereof and vertically displacing the coil as the outside diameter of the coil decreases as the material is paid off therefrom. Thus, the method controls the height at which the material is paid off from the coil. The method further includes dekinking a kinked portion of the material by compressing the kinked trailing end between independently moveable upper and lower rolls.

It is an object of the present invention to provide a material handling system having an uncoiler with a vertically adjustable mandrel rotatably mounted to a horizontally traversing carriage and having a payoff roll that cooperates with the mandrel to maintain a common payoff height of web material from a coil, regardless of the changing outside diameter of the coil, and within a certain vertical range. In this way, it is possible to easily center a coil along a material flow path through a feeder, to maintain a consistent angle of material flow from the uncoiler to a downstream device, and to minimize coil break of the web material.

It is another object to provide an uncoiler having an expandable mandrel for spearing an inside diameter of a coil of web material that enables uncoiling of heavy coils of light gauge stock, and thus eliminates the defect of a "wavy edge" of web material.

It is still another object to provide a reel-type uncoiler that eliminates the problems associated with side plates of a cradle-type uncoiler such as the need to precisely center the coil between the side plates, damage to side edges of the coil, binding of the coil between the side plates, and slivers generated from side edges of the coil abrading the side plates.

It is yet another object to provide a reel-type uncoiler that cooperates with a payoff roll to synchronize payoff of web material from a coil and to reduce slack conditions of web material being paid off from the coil.

It is a further object to provide a reel-type uncoiler that requires less floor space than prior art reel-type uncoilers and eliminates the typical material loop between prior art uncoilers and a downstream device.

It is still a further object to provide a material handling system that incorporates a dekinker for easy threading of a leading end of web material from a coil of web material to a downstream feeder.

It is yet a further object to provide a material handling system that incorporates a dekinker that eliminates kinks at the trailing ends or near the trailing edge of web material to wipe a kink flat and prevent double thicknesses of the web material from entering a feeder.

It is an additional object to provide low cost, efficient reel-type uncoiling apparatus that enables automation of web-type material handling, that requires less floor space than prior art reel-type uncoilers, and that does not require use of a pit to accommodate the apparatus.

It is yet an additional object to provide methods of conveying, dekinking, and handling a coil of web material in a manner consistent with the above-mentioned objects.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
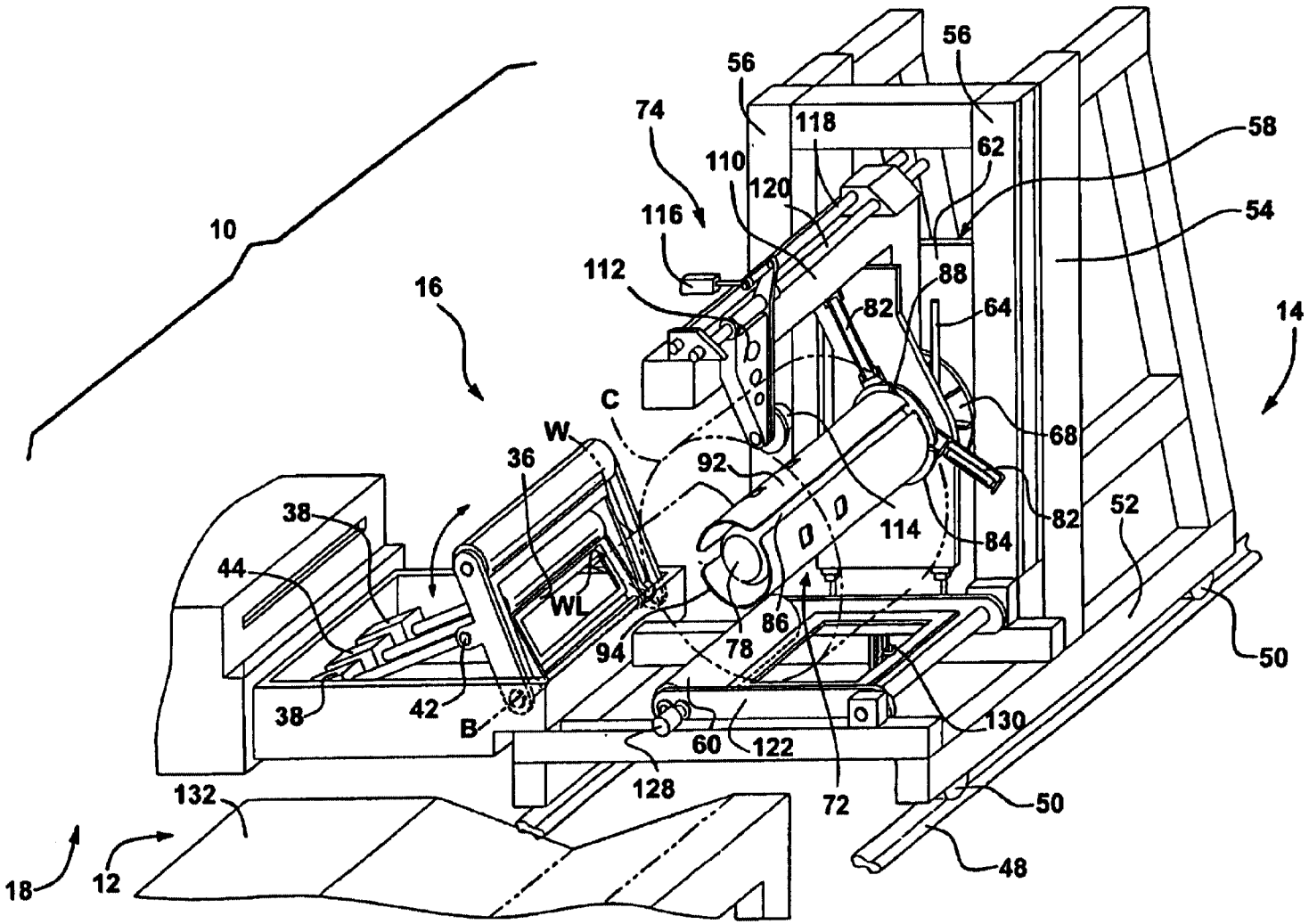
FIG. 1 is a perspective view of the material handling system of the present invention.

Referring now in detail to the Figures, there is shown in FIG. 1 a perspective view of a material handling system 10 that is used in accordance with a method of the present invention. The material handling system 10 is used to supply web material W, such as sheet steel, in a downstream direction along a line of material flow from a coil C to an end-use machine such as a stamping press (not shown). The material handling system 10 generally includes the following sub-structures: a loading cradle 12, an uncoiler 14, a dekinker 16, and a feeder 18.

The end-use machine uses the continuous web material W supplied by the material handling system 10 to make discrete products such as stampings. The end-use machine is located at the far downstream end of the material handling system 10 and dictates the rate at which web material W is to be supplied thereto. Therefore, the feeder 18 is used to feed the end-use machine with web material W and also to straighten the web material W.

Figure 2:
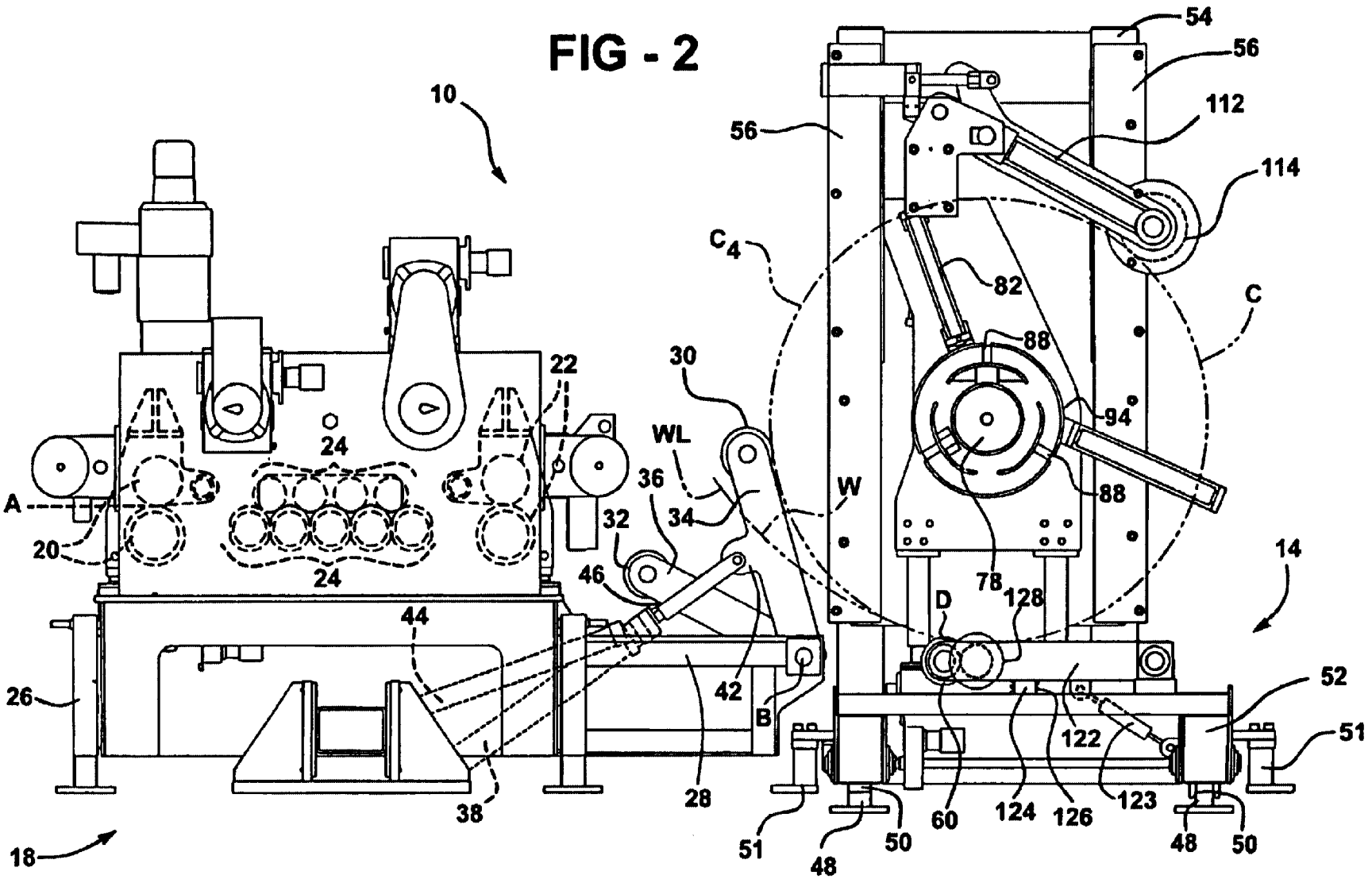
FIG. 2 is an elevational view of the material handling system of FIG. 1, illustrating a full coil mounted on a mandrel of an uncoiler being paid off from a payoff roll at a predetermined payoff height to input pinch rolls of a feeder, with a leading end of web material being threaded by a threader roll of a dekinker.

As best shown in FIG. 2, the feeder 18 is located just upstream of the end-use machine and is used to pull the web material W in a downstream direction toward the end-use machine (not shown). The feeder 18 includes a set of output feed rolls 20, a set of input feed rolls 22, and a set of straightening rollers 24 disposed therebetween, as is well known in the art. The input feed rolls 22 define an input passage of the feeder 18, while the output feed rolls 20 define an output passage at the downstream end of the feeder 18 that establishes a pass line A of the web material W to the end-use machine. As is also well known, the feeder 18 is mounted atop an adjustable height base frame 26, such that the height of the pass line A can be adjusted to accommodate varying pass lines, or deck heights, of end-use machines. At the upstream end of the feeder 18, there is an extension 28 of a base frame 26 that is cantilevered in an upstream direction.

Figure 3:
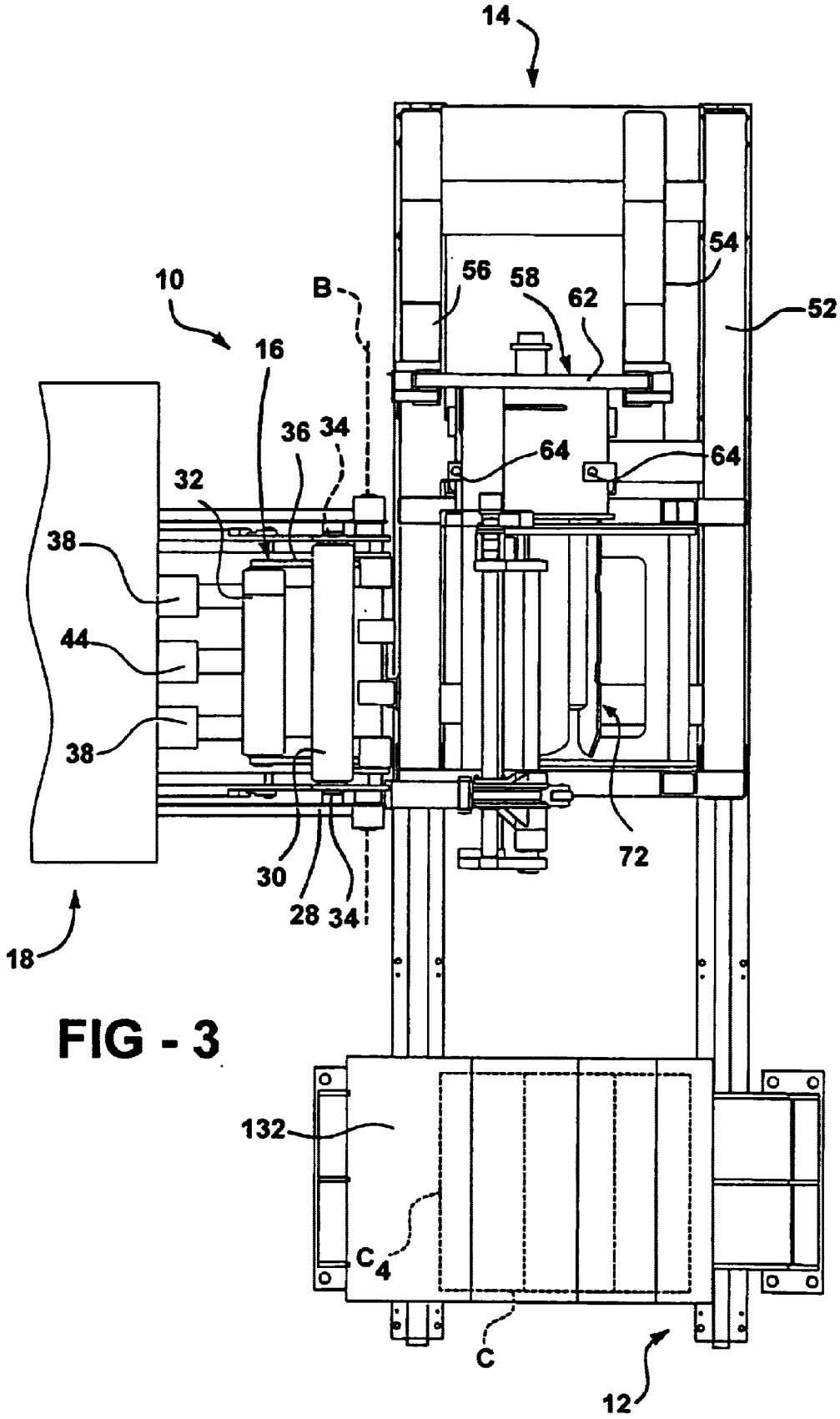
FIG. 3 is a plan view of the material handling system of FIG. 1.

Referring now to FIGS. 2 and 3, the dekinker 16 is located on an upstream side of the feeder 18 and is pivotably mounted to the extension 28 thereof. The dekinker 16 includes an upper or threader roll 30 and a lower or breaker roll 32 that cooperate as a double-arm dekinking device to straighten out the web material W, as is unique and as will be described in greater operational detail below. Additionally, the threader roll 30 operates independently as a threader device, as is well known in the art. The threader roll 30 is rotatably mounted between free ends of opposite threader pivot arms 34. In turn, the threader pivot arms 34 are pivotably mounted to corresponding coners of the extension 28 of the feeder 18. Likewise, the breaker roll 32 is pivotably mounted to a breaker pivot frame 36, wherein the breaker pivot frame 36 is pivotably mounted about a common axis B with the threader pivot arms 34. The breaker pivot frame 36 is shorter than the threader pivot arms 34 and is mounted inboard thereof such that the breaker roll 32 is disposed beneath the threader roll 30 throughout their respective operational envelopes. Thus, each roll is independently pivotable with respect to the other roll about the common axis B, and the rolls 30 and 32 are pivoted by hydraulic cylinders 38 and 44.

As best shown in FIG. 2, the hydraulic cylinders 38 and 44 include a pair of threader cylinders 38 and a single breaker cylinder 44. The threader cylinders 38 are basally secured to a downstream portion of the adjustable base frame 26 of the feeder 18 so as to be adjustable up and down with the feeder 18. Oppositely, the piston end of each cylinder 38 is secured to a lug portion 42 on each of the threader pivot arms 34 using a pin and clevis arrangement as is well known. The threader cylinders 38 are preferably Parker series 3L hydraulic cylinders with a 4" bore and a 29" stroke. Likewise, the breaker cylinder 44 is basally secured to a downstream portion of the adjustable base frame 26 of the feeder 18 and the piston end is secured to a central lug 46 portion depending from a cross-member of the breaker pivot frame 36 of the breaker roll 32. The breaker cylinder 44 is preferably a Parker series 3L also, with an 8" bore and a 35" stroke. Thus, the cylinders 38 and 44 stroke to pivot the threader and breaker rolls 30 and 32 about the common axis B.

Referring again to FIG. 1, the uncoiler 14 is disposed at an upstream end of the material handling system 10 when in home position, and is used to support and uncoil the coil of web material W as will be described in greater operational detail below. The uncoiler 14 is mounted to and traverses horizontally along guide rails 48 that extend transversely to the direction of the line of material flow and that terminate underneath the loading cradle 12. The guide rails 48 support a set of wheels 50 that mount atop the guide rails 48 and that are rotatably fixed at the corners of a horizontal and rectangular base frame 52. On one side of the base frame 52 the wheels 50 are preferably Hamilton double flanged wheels 50 #WFT-102SD series and on the opposite side of the base frame 52 the wheels 50 are preferably Caster Concepts series #1040. As shown in FIG. 2, a set of keepers 51 engage a portion of the base frame 52 to keep the wheels 50 down on the guide rails 48.

Referring again to FIG. 1, the base frame 52 supports a payoff roll 60 and a vertical A-frame 54 that is fixed at one end distal the loading cradle 12. The vertical A-frame 54 includes twin slides 56, the primary purpose of the vertical A-frame 54 being to support a vertically traversing subframe 58. As can best be seen in FIG. 4, the subframe 58 is L-shaped, having a vertical portion 62 that displaceably mounts within channels of the twin slides 56 of the vertical A-frame 54 as is well known in the art of machine tool design. Twin screw jacks 64 thread through and drive a horizontal portion 65 of the subframe 58, as is also well known. The screw jacks 64 are preferably Joyce brand 20 ton #WJ820-50-upright-KFTN series jacks with an 8:1 ratio and 50" rise. The twin screw jacks 64 are preferably powered by a single common motor and drivetrain, as is also well known. Preferably, a Char-Lynn series 600 hydraulic motor connects to a Joyce drivetrain 66 to power the jacks 64. Alternatively, the subframe 58 could be displaceably mounted using other devices such as hydraulic cylinders, for example. Cantilevered from the vertical portion 62 of the subframe 58 there extends a mandrel housing 68, a guide plate 70, an expandable mandrel 72, and a hold-down assembly 74 mounted atop the mandrel housing 68.

Figure 4:
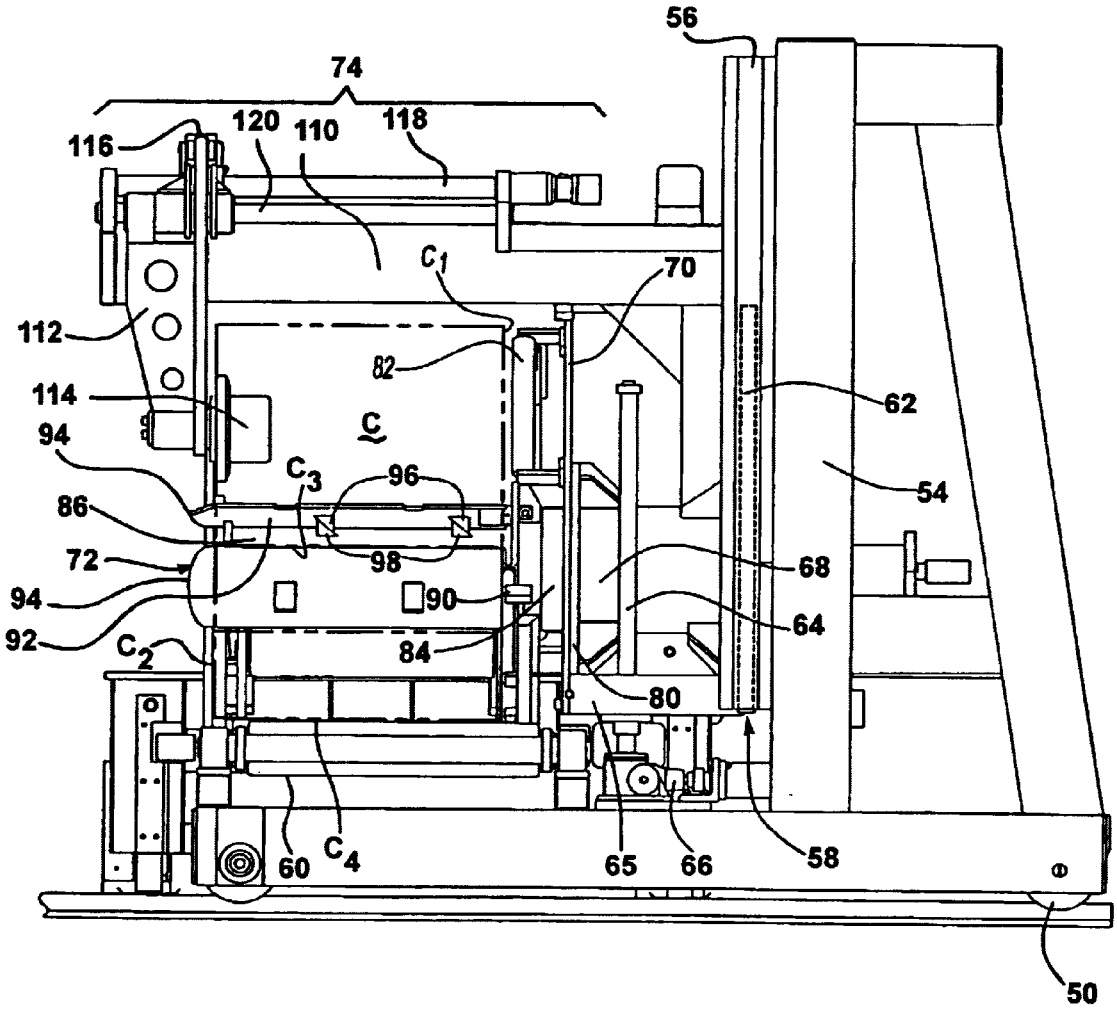
FIG. 4 is a side elevational view of the material handling system of FIG. 1, looking downstream along the direction of material flow.

Referring back to FIG. 1, the mandrel housing 68 is a weldment used to support a fixed end of a drawbar therein (not shown), as is consistent with typical expandable mandrel design. The drawbar extends longitudinally from the mandrel housing 68 in a direction toward the loading cradle 12 and terminating in an outboard end or retaining plate 78, thereby defining the axis of the mandrel 72. As shown in FIG. 4, the mandrel housing 68 terminates in a flange portion 80, distal the A-frame 54. Against this flange portion 80, one side of the guide plate 70 is mounted and the opposite side of the guide plate 70 is used to support guide rollers 82 for guiding an inboard side $C_1$ of the coil C. The guide rollers 82 keep the inboard side $C_1$ of the coil C square to an outside diameter $C_4$ of the coil C and thereby helps prevent telescoping of the coil C. On this opposite side of the guide plate 70, a mandrel collar 84 circumscribes the drawbar of the mandrel 72.

Still referring to FIG. 4, the mandrel 72 is an expandable, reel-type device that is used to support the coil C from an inside diameter $C_3$ thereof so that the coil C can be rotated for unwinding or rewinding. The mandrel 72 is also used in a novel fashion to adjust the height of the coil C as will be discussed in more detail below. The mandrel 72 includes the following components: the drawbar composed of SAE 4140 steel (not shown); the collar 84 that is a weldment of steel; the retaining plate 78 that is connected to the drawbar and that is composed of hot rolled steel; and a sliding sleeve 86 that circumscribes the drawbar and that is composed of steel tubing or pipe. The mandrel 72 could be constructed of any standard expanding mandrel design and need not be restricted only to that disclosed herein.

The mandrel collar 84 is generally round and has three radial slots 88 in the periphery that are circumferentially and equally spaced about the collar 84, as best shown in FIG. 2. Referring back to FIG. 4, the three radial slots 88 act as guides for inboard ends 90 of three mandrel shoes 92. Each inboard end 90 of each mandrel shoe 92 interlocks within each corresponding radial slot 88 such that the mandrel shoe 92 is radially displaceable therein. Each mandrel shoe 92 extends longitudinally from the inboard end 90 in a direction along the drawbar of the mandrel 72 and terminates in an outboard end 94. Additionally, each mandrel shoe 92 includes a pair of internally tapered portions 96 that cooperate with opposed externally tapered portions 98 of the drawbar. Thus, the drawbar shifts in an inboard direction to outwardly displace the mandrel shoes 92 to increase the diameter of the mandrel 72, and the drawbar shifts in an outboard direction to inwardly displace the mandrel shoes 92 to decrease the diameter of the mandrel 72. The mandrel 72 is preferably expanded and contracted by shifting the drawbar back and forth under hydraulic pressure. Also, it is preferred to use a White hydraulic motor/brake #DT-6633290F in conjunction with an Air Flex air brake to rotate the mandrel 72 via an A.S.A. roller chain and a Martin sprocket (not shown).

Referring to FIGS. 1 and 4, the hold-down assembly 74 includes a support arm 110 that has a portion that extends vertically from the mandrel housing 68 and that has a portion that is cantilevered over top of the mandrel 72. A pivot arm 112 is pivotably mounted to a longitudinally extending shaft 120 that is mounted to the support arm 110. At the end of the pivot arm 112, a hold-down roll 114 is rotatably mounted. The hold-down roll 114 is inboard and has an outer diameter for engaging against the outside diameter $C_4$ of the coil C, and also has a flange for keeping an outboard side $C_2$ of the coil C square to the outside diameter $C_4$. A Parker pneumatic cylinder 116, 2A series with a 6" bore and a 12" stroke, is interposed the pivot arm 112 and the support arm 110. The cylinder 116 pneumatically pivots the pivot arm 112 clear of the coil C during loading and into engagement with the coil C when uncoiling. An ACME screw 118, model 12L14, threads through a portion of the pivot arm 112 to traverse the pivot arm 112 along the shaft 120 of the support arm 110 to accommodate varying widths of coils.

The hold-down roll 114 is used to apply hold-down pressure to the outside diameter $C_4$ of the coil C and to keep the sides of the coil C from telescoping so that the coil C pays off web material W correctly. It is well known in any art relating to coiled sheet steel that the convolutions of some coils are under enormous stresses that tend to cause the coil C to expand or 'watchspring' after "bellybands" that encircle the coil C are cut. Thus, the hold-down roll 114 also applies pressure to the coil C to prevent it from exploding open once the bellybands are cut.

Figure 6A:
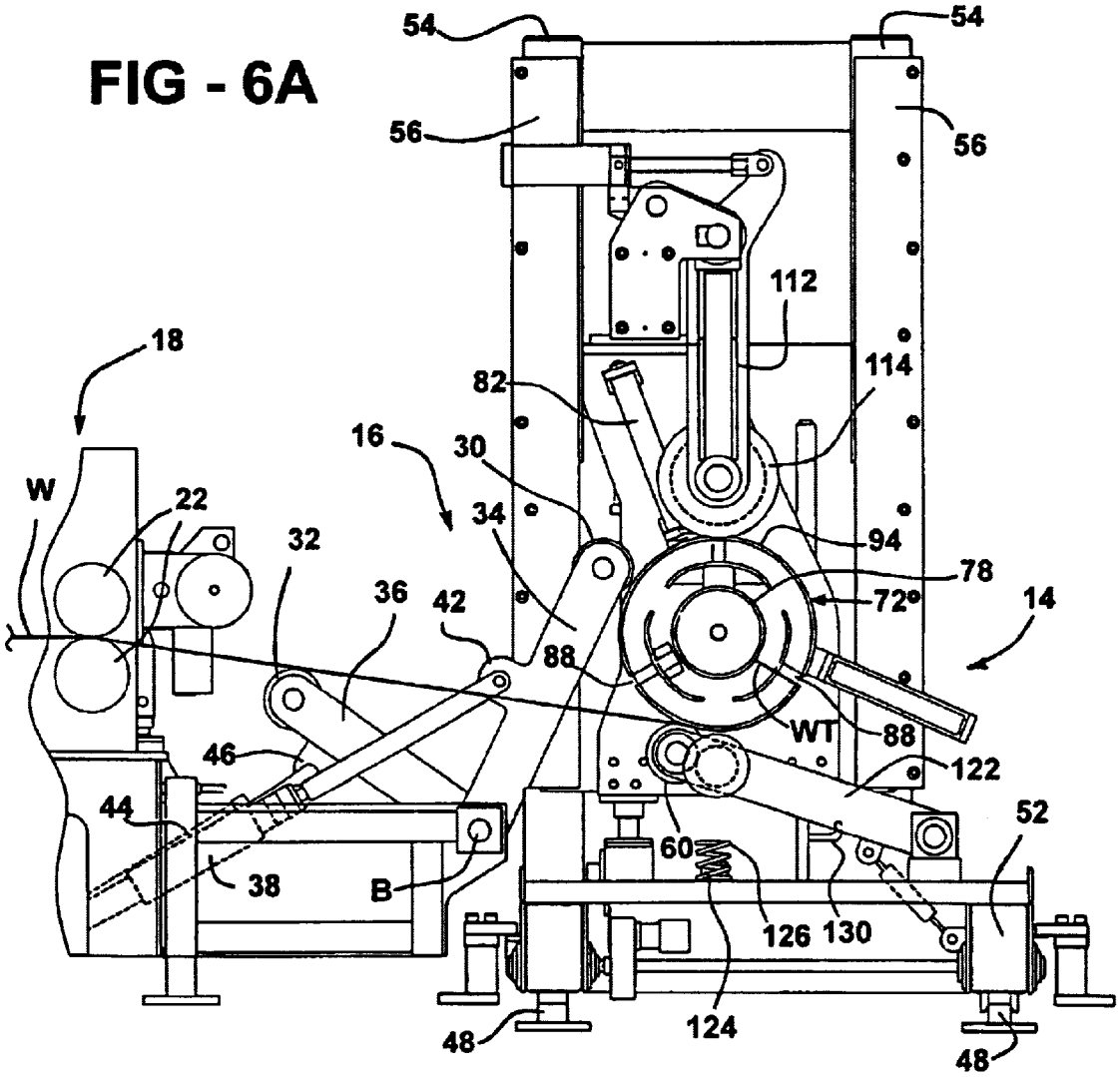
FIG. 6A is an elevational view of the material handling system of FIG. 1 illustrating the coil of web material almost completely uncoiled and terminating in a coil end bend.

Referring to FIGS. 1 and 2, the payoff roll 60 is positioned below the hold-down subassembly and the mandrel 72 and is a unique device used in conjunction with the mandrel 72 for several purposes. The payoff roll 60 establishes a lower rest for the coil C, much like the lower rollers of a cradle-type uncoiler do. Like the hold-down roll 114, the payoff roll 60 provides pressure to the outside diameter of the coil C to help prevent it from 'watchspringing'. More importantly, however, the payoff roll 60 establishes a line along which web material W is threaded, or paid off from the coil C in a downstream direction. As best shown in FIG. 2, the payoff roll 60 is pivotably mounted to the base frame 52 with a pivot arm 122, and is supported distal its pivot axis with a positive stop 124 and die spring 126 arrangement. Thus, the die spring 126 acts to pivot the pivot arm 122 and payoff roll 60. Additionally, an hydraulic cylinder 123 is mounted between the payoff pivot arm 122 and the base frame 52 to pivot the pivot arm 122 and payoff roll 60 into engagement with the outside diameter of the coil C as the coil C pays off and depletes. As best shown in FIGS. 1 and 6A, a limit switch 130 is mounted to the base frame 52 and cooperates with a portion of the payoff pivot arm 122 to monitor the height of the payoff roll 60 within a certain preset range of the limit switch 130. Additionally, it is preferred that a hydraulic payoff motor 128 be drivingly connected to the payoff roll 60 for driving the payoff roll 60 in unison with the unwinding mandrel 72 as the coil C is unwound. Such hydraulic motors and their connections to guide rolls are well within the ordinary skill in the art and need not be discussed in detail here.

Finally, as best shown in FIGS. 1 and 3, the loading cradle 12 provides a temporary resting place for the coil C until the uncoiler 14 comes to pick up the coil C. The loading cradle 12 supports the outside diameter $C_4$ of the coil C as is well known. The loading cradle 12 includes a horizontal bed 132 and a pair of vertical supports that are mounted to the shop floor, and is specially designed to accommodate cooperation with the uncoiler 14 in that it spans over top of the guide rails 48 to provide clearance for the base frame 52 of the uncoiler 14.

Referring to FIG. 2, the operation of the present invention involves both setting up and running the material handling system 10. During setup, a machine operator raises or lowers the adjustable base frame 26 of the straightener feeder 18 to match the height of the pass line A to the pass line of the downstream end-use machine, as is well known in the art. Then, the operator makes other adjustments to the feeder 18 to accommodate the stock thickness, feedrate, etc. Finally, the coil C of web material W is loaded to the loading cradle 12, via overhead crane or the like, and awaits the uncoiler 14, as best shown in FIG. 3. The coil C of web material W must be loaded to the loading cradle 12 with care so that the leading end of the web material will payoff in a downstream direction, from the bottom of the coil C.

Referring again to FIGS. 1 and 3, the operator runs the material handling system 10 using three different well-known types of controls including a pushbutton interface, a handheld device, and hand valves (not shown). The operator first advances the mandrel drawbar to minimize the diameter of the mandrel 72. The operator then traverses the empty uncoiler 14 along the guide rails 48 from its home position toward the coil C waiting atop the loading cradle 12 and stops at a distal pickup position underneath the loading cradle 12 in order to load a full coil C to the uncoiler 14. The uncoiler 14 is powered along the guide rails 48 preferably in a simple manner, using a hydraulic motor to power the axle mounted wheels 50. As the uncoiler 14 approaches the coil C, the operator adjusts the height of the mandrel 72 to align with the inside diameter $C_3$ of the waiting coil C. As the uncoiler 14 nears the end of the guide rails 48, a portion of the base frame 52, including the payoff roll 60, travels underneath and clear of the loading cradle 12 and coil C, while the retracted mandrel 72 spears the inside diameter $C_3$ of the coil C until the inboard side of the coil C locates against the guide rollers 82. At this point the operator retracts the mandrel drawbar to expand the mandrel shoes 92 and grip the inside diameter $C_3$ of the coil C. The operator then adjusts the mandrel 72 vertically to lift the coil C from the cradle and then returns the uncoiler 14 to its home position.

Back in the home position, the operator prepares the uncoiler 14 to uncoil the coil C. First, the operator lowers the hold-down roll 114 into engagement against the outside diameter $C_4$ of the coil C. Then, the operator lowers the subframe 58 to lower the mandrel 72 and hold-down roll 114 in unison until the outside diameter $C_4$ of the coil C displaces the payoff roll 60 either to bottom out the payoff roll 60 against the positive stop 124 when using heavy gauge material, or to trip the payoff limit switch 130 and halt vertical travel of the mandrel 72 when using light gauge material. Once the vertical travel of the mandrel 72 is halted at the payoff height, the operator prepares the coil C to be unleashed. Typically bellybands encircle the coil C to restrain it from watchspringing open.

Before the bellybands are cut, however, the operator activates the dekinker 16 to engage the threader roll 30 against the outside diameter of the coil C to safely and accurately convey web material W from the coil C, downstream to the input passage of the feeder 18. The operator activates the threader cylinders 38 to pivot the threader roll 30 into engagement with the outside diameter $C_4$ of the coil C. The operator rotates the mandrel 72 in a reverse direction until the leading end $W_L$ of the coil C is just above the threader roll 30. Then the operator can safely remove the bellybands. The operator again reverses rotation of the mandrel 72 until the leading end $W_L$ of the coil C rotates just below the threader roll 30 and springs outwardly from the outside diameter $C_4$ of the coil C, as shown in FIG. 2.

Now the operator advances rotation of the mandrel 72 so that the leading end $W_L$ of the coil C advances in a generally downstream direction. Simultaneously, the operator retracts the threader cylinders 38 to slowly pivot the threader roll 30 downstream in synchronization with the leading end $W_L$ of the web material W. The underside of the threader roll 30 engages the web material W proximate the leading end $W_L$ thereof and effectively directs or "threads" the web material W to the input feed rolls 22 of the feeder 18. Additionally, the operator can activate the breaker cylinder 44 to slowly pivot the breaker roll 32 in unison with the leading end $W_L$ of the web material W. As such, the topside of the breaker roll 30 engages the web material W proximate the leading end $W_L$ thereof to help steer or thread the web material W to the input feed rolls 22 of the feeder 18. Uniquely, the threader and breaker rolls 30 and 32 thus cooperate to easily thread web material W from the uncoiler 14 to the feeder 18. At this point, the leading end $W_L$ of the web material W is slowly advanced into the input passage and the operator closes the input feed rolls 22. The operator then activates the drive motor of the feeder 18 to pull the leading end $W_L$ of the web material W through the straightening rollers 24 in a wavy pattern to work and straighten the material, as is well known. The leading end $W_L$ of the web material W then passes between the output feed rolls 20 and out to the end-use machine along the pass line A.

It is preferable that as the material handling system 10 runs, web material W is paid off from the coil C, thereby decreasing the outside diameter $C_4$ thereof. Preferably, the mandrel 72 maintains vertical position so that the payoff height of the coil C gradually approaches the outer diameter of the mandrel 72 until the coil C is depleted. This provides for a gradually decreasing angle of payoff from the uncoiler 14 to the feeder 18.

In the alternative, however, it is contemplated that the payoff height of the coil C could be maintained by gradually lowering the height of the mandrel 72 as the material pays off from the coil C. Under upward pressure from the die springs 126 and/or the hydraulic cylinder 123, the payoff pivot arm 122 rises approximately an inch before the pivot arm 122 trips the payoff limit switch 130, thereby automatically initiating downward vertical travel of the mandrel 72. The mandrel 72 drops until it again bottoms out the payoff roll 60. Thus, the uncoiler 14 automatically maintains a height of the payoff roll 60 and hence a payoff height of the web material W that is within a certain preset tolerance of preferably about an inch.

The ability to maintain the payoff height is a particularly unique aspect of the present invention. In the prior art of cradle-type uncoilers, maintaining the payoff height was not an issue. Since the outside diameter of a coil always rested on the cradle along virtually a constant line regardless of the diameter of the coil, a consistent payoff height could be achieved. As discussed in the Background section, heavy coils of light gauge material necessitate use of a reel-type mandrel uncoiler. Such uncoilers, however, present a challenge in maintaining the payoff height.

Figure 5:
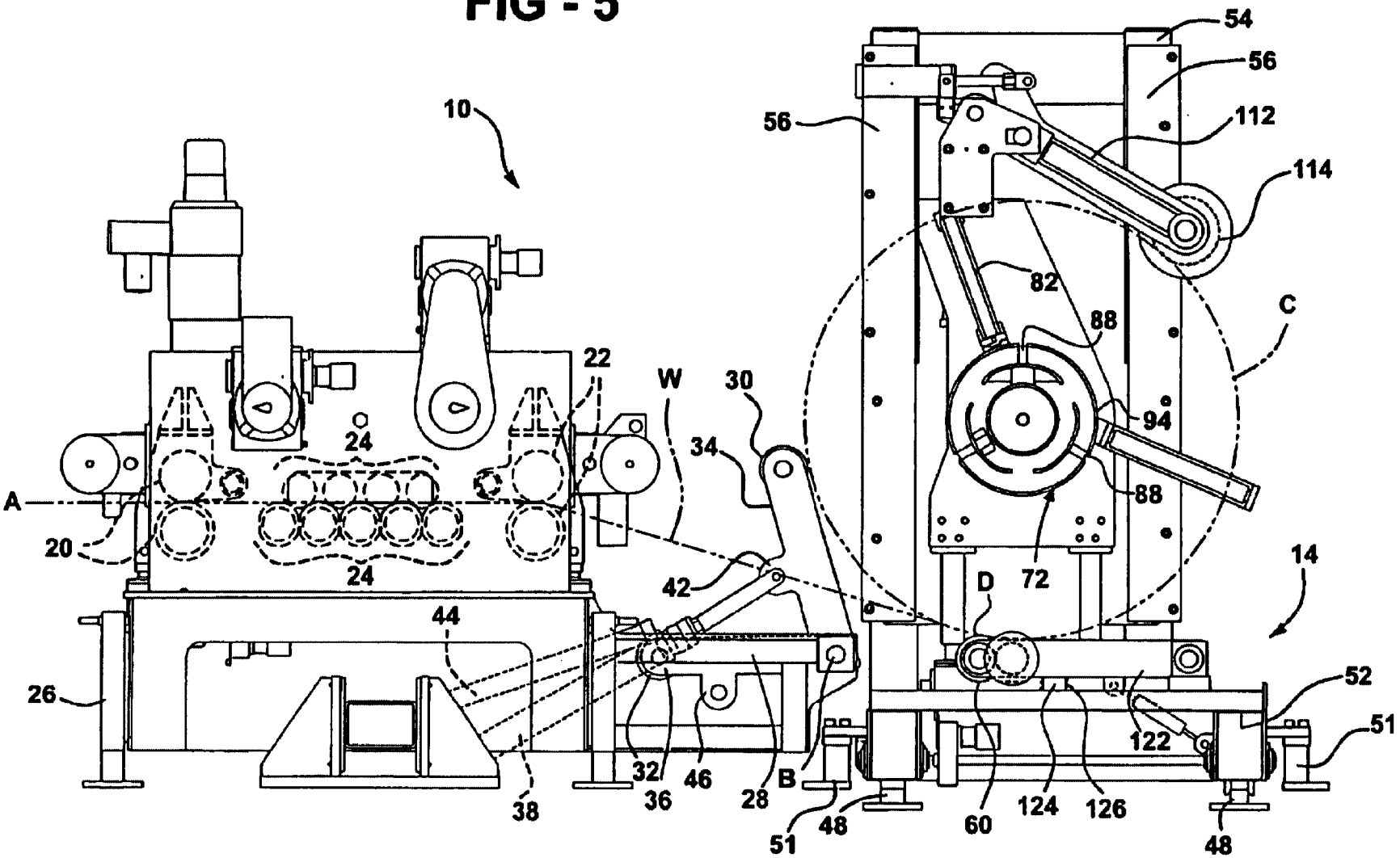
FIG. 5 is an elevational view of the material handling system of FIG. 1, illustrating the mandrel vertically adjusted downwardly to maintain the threading payoff height.

As shown in FIG. 5, the payoff height is defined between the payoff roll 60 and the outside diameter $C_4$ of the coil C and establishes the line at which the web material W separates from the outside diameter $C_4$ of the coil C and pays off in a downstream direction. Thus, the payoff height can also be referred to as the payoff line D, where line D is shown extending into FIG. 5 along the length of the payoff roll 60. The height of the payoff line D is maintained preferably within a tolerance about an inch, which can be set by adjusting the limits of the limit switch 130.

An alternative arrangement could be employed to more precisely and continuously maintain the payoff height in real time at a constant height with virtually no tolerance. For example, it is possible to incorporate a linear scale device (not shown) between the base frame 52 and the payoff roll 60 instead of the limit switch 130. In this way, the linear scale would provide continuous positional feedback via a control system (not shown) to the jackscrew drivetrain 66 to continuously adjust the height of the mandrel 72 to compensate for the ever-decreasing diameter of the coil C.

Referring to FIG. 2, automatic vertical adjustment of the mandrel 72 enables the uncoiler to maintain a common payoff line D of the coil C and thus yields benefits normally associated with a cradle-type uncoiler rather than a reel-type uncoiler. First, it is relatively easy to thread the leading end $W_L$ of the material to the input passage of the feeder 18. Once the coil C has engaged the payoff roll and halted, the leading end $W_L$ of the web material W is consistently located regardless of the size of the coil C. Therefore, the threader roll 30 can consistently engage and thread the leading end $W_L$.

Second, the angle at which the material is paid off from the payoff line D to the input passage of the feeder 18 remains consistent thereby minimizing coil break or unnecessary bending of the material. As depicted in FIG. 5, it is significant that there is only a very slight angle of the payoff path from the payoff line D of the uncoiler to the input feed rolls of the feeder 18. In other words, the input passage of the feeder 18 is only slightly elevated with respect to the pass line A, thus inducing a very low bend rate of the steel. Therefore, the steel web material W does not reach its yield point in being paid off from the uncoiler and being pulled into the feeder 18. The configuration of the present invention also requires very little floor space compared to prior art units, some of which require large loops of the web material W between an uncoiler and feeder.

Referring now to FIGS. 6A through 6D, after threading and feeding the web material W, the material handling system 10 can be run continuously in an automatic mode until the end of the coil C is reached and a trailing end $W_T$ of the web material W needs to be dekinked. The threader roll 30 cooperates with the breaker roll 32 to decurl, dekink, or straighten out the trailing end $W_T$ of the web material W, when necessary such as for severe kink for heavy gauge. It is desirable to dekink the trailing end $W_T$ for easier acceptance by the input feed rolls 22 of the feeder 18 and to prevent a double thickness of web material W from being rolled over and pulled into the feeder 18, thereby avoiding damage and downtime of the feeder 18 and end-use machine.

Figure 6B:
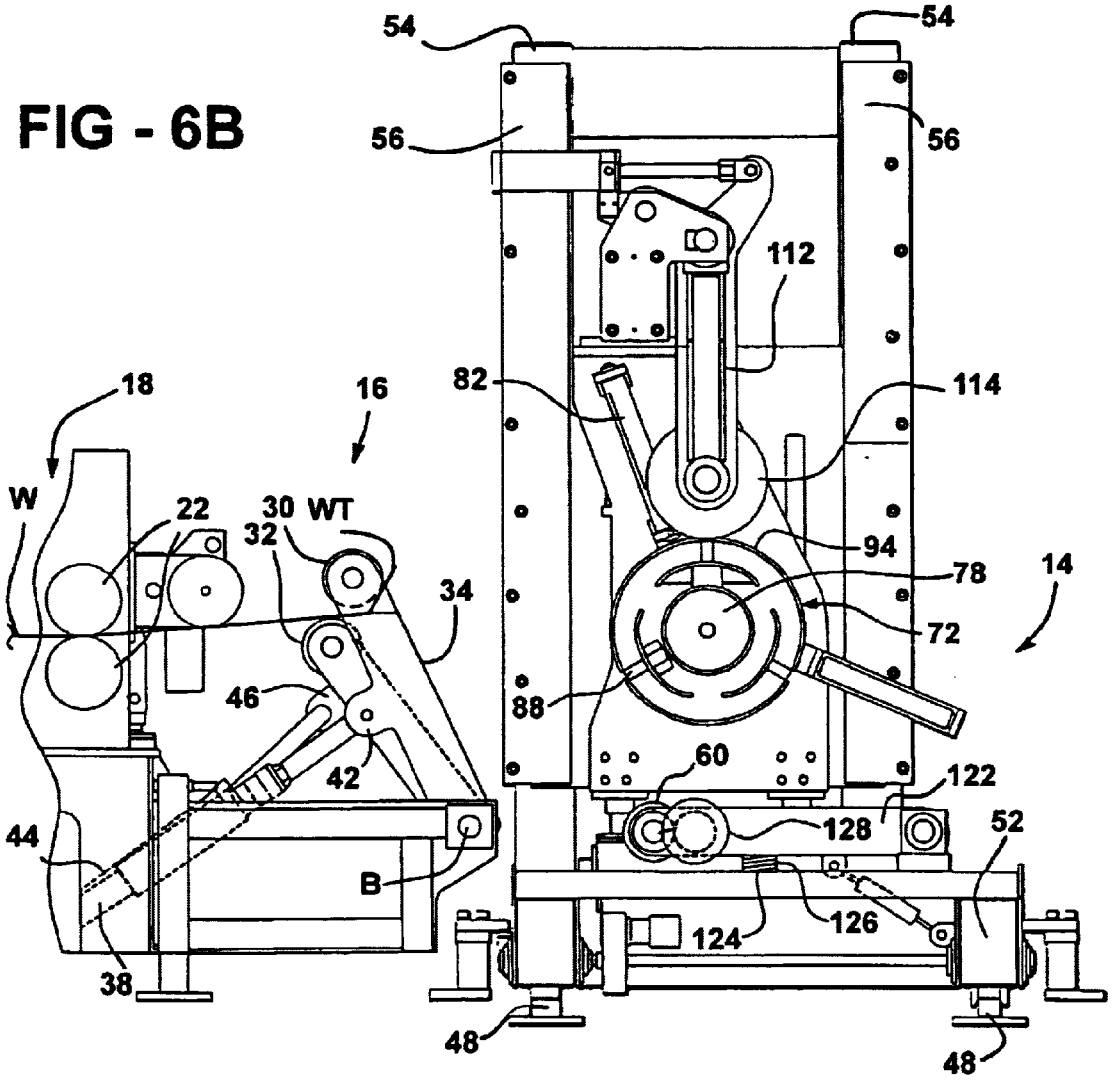
FIG. 6B is an elevational view of the material handling system of FIG. 1, illustrating the coil end bend interposed the threader roll and breaker roll, just prior to being compressed therebetween.
Figure 6C:
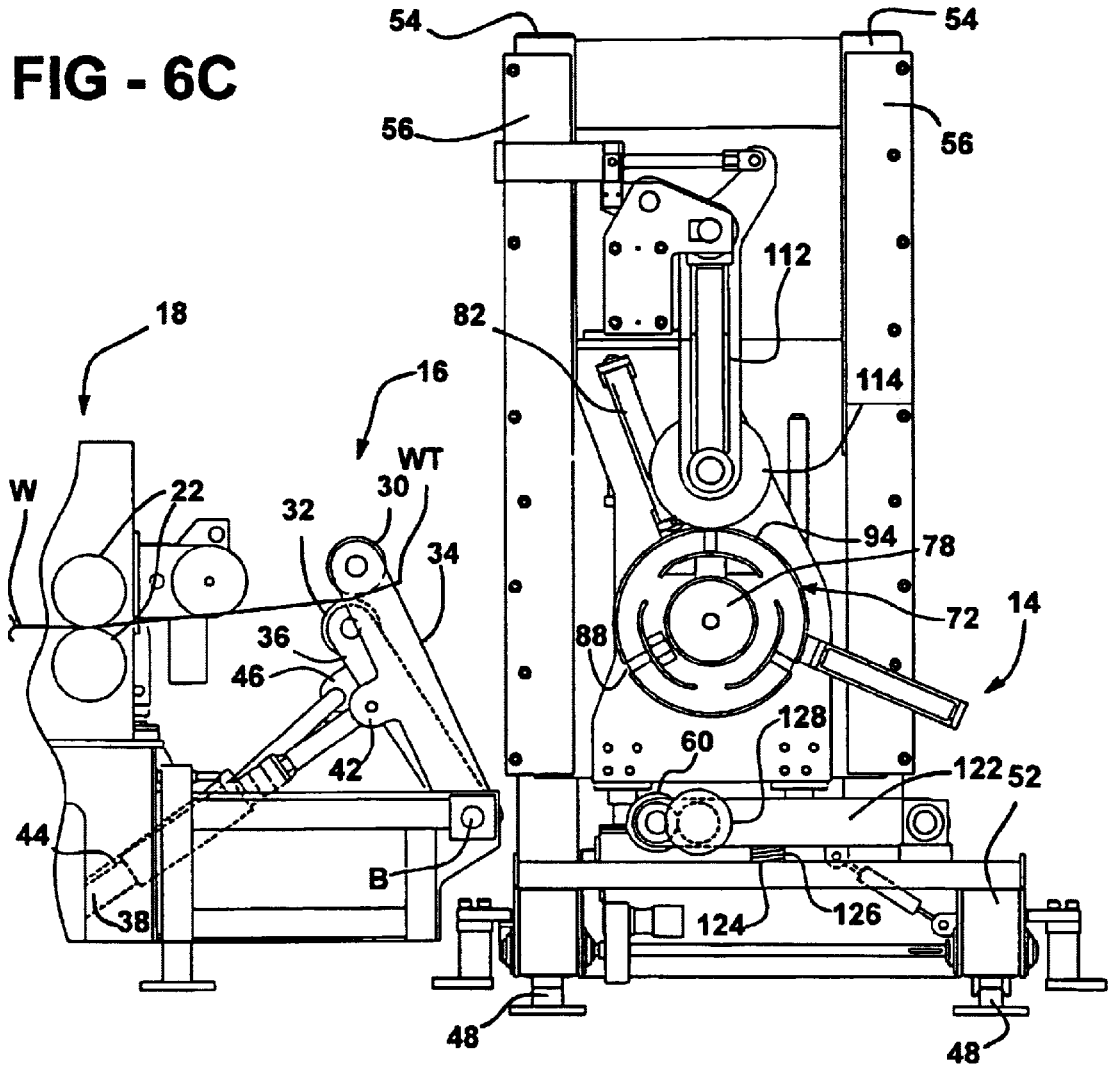
FIG. 6C is an elevational view of the material handling system of FIG. 1, illustrating the breaker roll and threader roll pivoting relatively toward one another to straighten out the bend near the trailing edge of the web material.
Figure 6D:
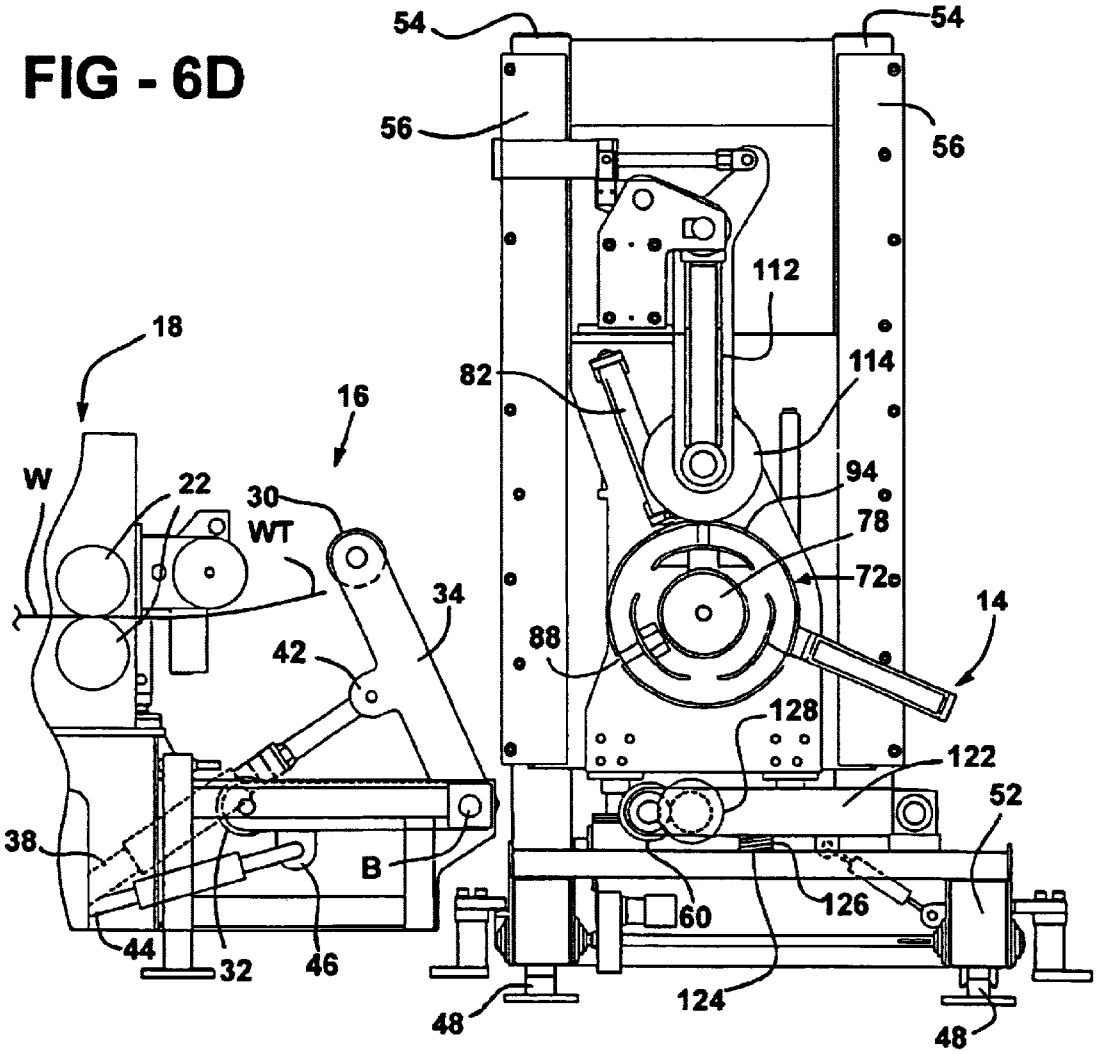
FIG. 6D is an elevational view of the material handling system of FIG. 1, illustrating the straightened out trailing edge of the web material being pulled into the feeder.

The dekinker 16 acts to straighten out the kinked trailing end $W_T$ of the web material W. The dekinker 16 can also be used to dekink a kinked leading end $W_L$ if necessary. FIG. 6A illustrates the initial end-of-coil condition that alerts the operator to take action. First, the threader roll 30 is positioned just right of vertical. Then, the breaker roll 32 is pivotably advanced from its home position to apply pressure to the underside of the web material W to push the web material W upward and behind the threader roll 30. FIG. 6B illustrates the breaker roll 32 applying upward pressure to the material W and further illustrates the kinked trailing end $W_T$ of the web material W in initial engagement with the threader roll 30. By this point, the threader roll 30 has already pivotably retracted to a position just left of vertical in synchronization with the kinked trailing end $W_T$ of the web material W. FIG. 6C illustrates the camming action on the web material W between the rolls. Here, the threader roll 30 and the web material W are preferably held stationary while the breaker roll 32 continues to pivotably extend toward the threader roll 30. The camming action compresses the bend of the kinked trailing end $W_T$ between the top of the breaker roll 32 and the bottom of the threader roll 30. Due to the high forces achievable with the camming action associated with two pivotable rolls, the dekinker 16 is especially effective for removing kinks in heavy gauge web material W. Finally, FIG. 6D simply illustrates the now dekinked trailing end $W_T$ of the web material W being pulled into the feeder 18.

Significantly, the dekinker 16 can also be used with a prior art cradle-type uncoiler and is not restricted to use with the traversing reel-type uncoiler 14 disclosed herein. Accordingly, the dekinker 16 acts not only also as a threader, but also as a coil catch to locate the coil C when it is dumped into the cradle-type uncoiler, and prevents the coil C from watchspringing.

Referring now in general to all of the drawing figures, a method of conveying material from a coil of the material to a machine downstream is also provided. The method includes the following steps: uncoiling the coil of material, dekinking leading and trailing ends and of the material, and feeding the material to a downstream end-use machine along a pass line.

The uncoiling step is conducted by supporting the coil from an inside diameter thereof and vertically displacing the coil as the outside diameter of the coil decreases as the web material is paid off from the coil in order to control the height at which the material is paid off from the coil. The outside diameter of the coil is engaged in line contact to define a payoff line of the coil at which height the web material is paid off from the coil. The outside diameter of the coil is preferably engaged in line contact by pivoting a roll into line contact with the outside diameter of the coil. The height of the payoff line is sensed, wherein the height of the coil C is vertically displaced in response thereto to maintain a payoff height within a predetermined tolerance range. The coil is vertically displaced to correlate the height of the payoff line with adjustments made to the height of the pass line and to maintain a common payoff height of the web material within a predetermined tolerance range.

The dekinking step is conducted by compressing a kinked trailing end of the material between independently moveable upper and lower rolls. The independently moveable upper and lower rolls are driven with respect to one another to compress the kinked portion, preferably by pivoting the independently moveable upper and lower rolls with respect to one another about a common pivot axis to compress the kinked portion.

The present invention has been described with reference to one of ordinary skill in the art of building material handling systems for coiled material. The materials and components used are considered readily available machine tool building materials and the novelty of the invention lies not in the materials but rather in the useful, unique, and unobvious configuration of those materials. For example, switches, sensors, and controls are well known in the art of material handling systems, and any specific selection of such subsystems are considered merely tangential to the novelty of the present invention.

While the present invention has been described in terms of a preferred embodiment, it is apparent that other forms could be adopted by one skilled in the art. For example, the teachings of the present invention encompass any reasonable substitutions or equivalents of claim limitations. A specific example includes mounting the dekinker rolls in a linear displaceable manner instead of mounting them in a pivotable displaceable manner, as shown and described herein. Moreover, the height adjustment of the uncoiler could be reversed such that the coil could be paid off from the top instead of the bottom. Those skilled in the art will appreciate that other applications, including those outside of the automotive industry, are possible with this invention.

Accordingly, the present invention is not limited to only coil and steel stamping material handling systems and can easily be adapted for use with film, paper, and wire uncoiling and the like. Accordingly, the scope of the present invention is to be limited only by the following claims.

What is claimed is:

1. An apparatus for conveying material from a coil of said material, wherein said material is paid off from said coil to a machine downstream of said apparatus, said coil of material having an inside diameter and an outside diameter, said apparatus comprising:

means for feeding said material to said machine;

means for dekinking a kinked portion of said material, said means for dekinking positioned upstream of said means for feeding, said means for dekinking comprising independently displaceable upper and lower rolls and further comprising means for compressing said material therebetween; and means for uncoiling said material from said coil, said means for uncoiling being positioned upstream of said means for dekinking, said means for uncoiling comprising:

means for supporting said coil from said inside diameter thereof; and means for vertically displacing said coil to control the height at which said material is paid off from said coil.

2. The apparatus as claimed in claim 1, further comprising means for pivoting said independently displaceable upper and lower rolls.

3. The apparatus as claimed in claim 2, wherein said means for pivoting comprises said independently displaceable upper and lower rolls pivoting off of a common axis.

4. The apparatus as claimed in claim 1, further comprising means for engaging said outside diameter of said coil in line contact to establish a payoff line of said coil from which said material is paid off from said coil.

5. The apparatus as claimed in claim 4, wherein said means for engaging further comprises means for pivoting said means for engaging about a pivot axis.

6. The apparatus as claimed in claim 5, further comprising means for sensing the height of said payoff line, said means for sensing being in contact with said means for engaging and said means for vertically displacing said coil, wherein as said outside diameter of said coil decreases as said material is paid off therefrom, said means for engaging trips said means for sensing to activate said means for vertically displacing to maintain a common payoff height within a predetermined tolerance range.

7. The apparatus as claimed in claim 4, wherein said means for feeding comprises:

an inlet passage;

an outlet passage downstream of said inlet passage, said outlet passage establishing a pass line to said machine; and means for adjusting the height of said pass line.

8. The apparatus as claimed in claim 7, wherein said means for vertically displacing said coil vertically adjusts the height of said coil to correlate said payoff line with adjustments made to the height of said pass line.

9. An apparatus for dekinking a kinked portion of material from a coil of said material, wherein said material is paid off from said coil to a machine downstream of said apparatus, said apparatus comprising:

independently displaceable upper and lower rolls positioned downstream of said coil, material flowing therebetween;

means for pivoting said independently displaceable upper and lower rolls, said pivoting means pivoting said independently displaceable upper and lower rolls about a common axis; and means for driving said independently displaceable upper and lower rolls relatively one another to straighten out said kinked portion of material therebetween.

10. The apparatus as claimed in claim 9, wherein said means for pivoting further comprises:

a frame;

a plurality of structural members pivotably mounted to said frame;

a plurality of hydraulic cylinders pivotably mounted to and between a downstream portion of said frame and said plurality of structural members.

11. An apparatus for handling a coil of material, said material being paid off from said coil to a machine downstream of said apparatus, said coil having an inside diameter and an outside diameter, said apparatus comprising:

an expandable mandrel;

means for supporting and uncoiling said coil from said expandable mandrel;

a payoff roll pivotally mounted between said expandable mandrel and said machine, said payoff roll engaging an outside surface of said material on said coil of material in direct contact to establish a payoff line at a predetermined angle between said payoff roll and said machine; and means for displacing said coil along a single axis to substantially maintain the angle of said payoff line, between said payoff roll and said machine downstream of said coil.

12. The apparatus as claimed in claim 11, wherein said means for supporting said coil comprises:

a horizontally traversing frame; and an expandable mandrel vertically moveably mounted thereto.

13. The apparatus as claimed in claim 11, wherein said means for vertically displacing and said means for supporting comprise:

a vertical slide;

a subframe slidably mounted to said vertical slide;

at least one powered screw threaded into a portion of said subframe for vertically displacing said subframe; and an expandable mandrel rotatably mounted to said subframe.

14. The apparatus as claimed in claim 11 further comprising means for pivoting said payoff roll, said pivoting means having a pivot axis.

15. The apparatus as claimed in claim 14, further comprising means for sensing the height of said payoff line, said means for sensing being in contact with said means for engaging and said means for vertically displacing said coil, wherein as said outside diameter of said coil decreases as said material is paid off therefrom, said means for engaging trips said means for sensing to activate said means for vertically displacing to maintain a common payoff height within a predetermined tolerance range.

16. The apparatus as claimed in claim 15, wherein said means for sensing comprises a limit switch in contact with said means for pivoting said payoff roll.

17. An apparatus for conveying material paid off from a coil of said material to a machine downstream of said apparatus, said coil having an inside diameter and an outside diameter, said apparatus comprising:

a feeder;

a dekinker positioned upstream of said feeder, said dekinker comprising:

a threader roll; and a breaker roll positioned below said threader roll, said threader and breaker rolls being independently displaceable with respect to one another to straighten out a kinked length of said material therebetween; and an uncoiler positioned upstream of said dekinker, said uncoiler comprising:

a mandrel extending through said inside diameter of said coil; and a displacement apparatus mounted to said mandrel for vertically displacing said mandrel to control the height at which said material is paid off from said coil.

18. The apparatus as claimed in claim 17, wherein said dekinker further comprises a threader pivot arm terminating in said threader roll and a breaker pivot arm terminating in said breaker roll.

19. The apparatus as claimed in claim 18, wherein said threader pivot arm and said breaker pivot arm pivot about a common axis.

20. The apparatus as claimed in claim 17, wherein said uncoiler further comprises a payoff roll engaged against said outside diameter of said coil in line contact to define a payoff line of said coil from which said material is paid off from said coil.

21. The apparatus as claimed in claim 20, wherein said uncoiler further comprises a payoff pivot arm terminating in said payoff roll.

22. The apparatus as claimed in claim 21, wherein said uncoiler further comprises a sensor in contact with said payoff pivot arm for sensing the height of said payoff line, wherein as said outside diameter of said coil decreases as said material is paid off therefrom said payoff pivot arm pivots and trips said sensor which activates said displacement apparatus to adjust the height of said mandrel accordingly to maintain a common payoff height within a predetermined tolerance range.

23. The apparatus as claimed in claim 20, wherein said feeder comprises:

an inlet passage at an upstream end;

an outlet passage at a downstream end, said outlet passage defining a pass line to said machine; and means for adjusting the height of said pass line.

24. The apparatus as claimed in claim 23, wherein said uncoiler adjusts the height of said coil to correlate the height of said payoff line with adjustments made to the height of said pass line.

25. An apparatus for dekinking a portion of material from a coil, wherein said material is paid off from said coil to a machine downstream of said apparatus, said apparatus comprising:

a threader roll;

a breaker roll positioned below said threader roll;

a frame supporting said threader roll and said breaker roll positioned below said threader roll;

a threader pivot arm pivotably mounted to said frame and terminating in said threader roll;

a breaker pivot frame pivotably mounted to said frame and terminating in said breaker roll; and means for pivoting said threader pivot arm and said breaker pivot frame off of a common axis;

wherein said material flows between said threader and breaker rolls and said threader and breaker rolls are displaceable with respect to one another to straighten out a kinked length of said material therebetween.

26. The apparatus as claimed in claim 25, further comprising:

hydraulic cylinders pivotably mounted between a downstream portion of said frame and at least one of said threader pivot arm and said breaker pivot frame.

27. An apparatus for handling a coil of material, wherein said material is paid off from said coil to a machine downstream of said apparatus, said coil having an inside diameter and an outside diameter, said apparatus comprising:

a expandable mandrel positioned within said inside diameter of said coil;

a payoff roll pivotally mounted and adjoining said material of said coil of material to engage an outside surface of said material on said coil of material in direct contact to establish a payoff line at a predetermined angle between said payoff roll and said machine downstream of said coil; and an uncoiling apparatus connected to said expandable mandrel for displacing said expandable mandrel along a single axis to maintain said predetermined angle of said payoff line between said payoff roll and said machine downstream of said coil.

28. The apparatus as claimed in claim 27, further comprising a payoff pivot arm terminating in said payoff roll.

29. The apparatus as claimed in claim 28, further comprising a sensor in contact with said payoff pivot arm for sensing the height of said payoff line, wherein as said outside diameter of said coil decreases as said material is paid off therefrom said payoff pivot arm pivots and trips said sensor which activates said displacement apparatus to adjust the height of said mandrel accordingly to maintain a common payoff height within a predetermined tolerance range.

30. The apparatus as claimed in claim 29, wherein said sensor comprises a limit switch in contact with said payoff pivot arm.

31. The apparatus as claimed in claim 27, further comprising a horizontally traversing carriage to which said mandrel is moveably mounted, said mandrel being an expandable mandrel.

32. The apparatus as claimed in claim 27, wherein said mandrel is rotatably mounted to a portion of said subframe and said mandrel is expandable.

33. A method of conveying material from a coil of said material to a machine downstream, said method comprising the steps of:

uncoiling said coil of material, said uncoiling step comprising the steps of:

supporting said coil from an inside diameter thereof; and vertically displacing said coil as an outside diameter of said coil decreases as said material is paid off from said coil to control the height at which said material is paid off from said coil;

dekinking a kinked portion of said material by compressing said kinked portion of said material between independently moveable upper and lower rolls; and feeding said material to said machine along a pass line.

34. The method as claimed in claim 33, wherein said dekinking step further comprises the step of driving said independently moveable upper and lower rolls with respect to one another to compress said kinked portion.

35. The method as claimed in claim 34, wherein said dekinking step further comprises the step of pivoting said independently moveable upper and lower rolls with respect to one another to compress said kinked portion.

36. The method as claimed in claim 33, wherein said uncoiling step further comprises the step of engaging said outside diameter of said coil in line contact to define a payoff line of said coil from which said material is paid off from said coil.

37. The method as claimed in claim 36, wherein said engaging step comprises pivoting a roll into line contact with said outside diameter of said coil.

38. The method as claimed in claim 36, wherein said uncoiling step further comprises the step of sensing the height of said payoff line, wherein the height of said coil is vertically displaced in response thereto to maintain a common payoff height within a predetermined tolerance range.

39. The method as claimed in claim 38, wherein said uncoiling step further comprises the step of vertically displacing said coil to correlate the height of said payoff line with adjustments made to the height of said pass line.

40. A method of dekinking a portion of material from a coil, wherein said material is paid off from said coil to a machine downstream, said method comprising the steps of:

feeding said material between upper and lower pivotable rolls;

Pivoting said upper and lower rolls from a common pivot axis; and pivoting said upper and lower rolls relatively toward one another to compress a kinked length of said material between said upper and lower pivotable rolls to dekink said material.

41. A method of handling a coil of material wherein said material is paid off from said coil to a machine downstream of said coil, said method comprising the steps of:

supporting said coil along an inside diameter thereof;

engaging an outside surface of said material on said coil in line contact to establish a payoff line at a predetermined angle between said payoff roll and said machine downstream of said coil; and traversing said coil along a single axis to substantially maintain the position of said predetermined angle of said payoff line of said material as said material is unwound from said coil.

42. The method as claimed in claim 41, wherein said engaging step further comprises the step of pivoting a roll into line contact with said outside diameter of said coil.

43. The method as claimed in claim 41, wherein said uncoiling step further comprises the step of sensing the height of said payoff line, wherein the height of said coil is vertically displaced in response thereto to maintain a common payoff height within a predetermined tolerance range.

* * * * *